US012270285B2

(12) United States Patent
Tompkins et al.

(10) Patent No.: US 12,270,285 B2
(45) Date of Patent: Apr. 8, 2025

(54) ENHANCED ARTIFICIAL LIFT FOR OIL AND GAS WELLS

(71) Applicant: LateraLift, LLC, The Woodlands, TX (US)

(72) Inventors: Charles R Tompkins, The Woodlands, TX (US); Mathew A. Eagleston, Keller, TX (US); Robert Michael Taylor, Perkins, OK (US); John Whitsitt, Houston, TX (US); Jody Ray McGlothen, Brighton, CO (US)

(73) Assignee: LATERALIFT, LLC, The Woodlands, TX (US)

( * ) Notice: Subject to any disclaimer, the term of this patent is extended or adjusted under 35 U.S.C. 154(b) by 0 days.

(21) Appl. No.: 18/453,409

(22) Filed: Aug. 22, 2023

(65) Prior Publication Data

US 2024/0060404 A1 Feb. 22, 2024

Related U.S. Application Data

(60) Provisional application No. 63/439,389, filed on Jan. 17, 2023, provisional application No. 63/399,790, filed on Aug. 22, 2022.

(51) Int. Cl.
*E21B 43/12* (2006.01)

(52) U.S. Cl.
CPC ..... *E21B 43/128* (2013.01); *E21B 43/123* (2013.01)

(58) Field of Classification Search
CPC ..... E21B 43/128; E21B 43/123
See application file for complete search history.

(56) References Cited

U.S. PATENT DOCUMENTS

| | | | | |
|---|---|---|---|---|
| 10,590,748 | B2 * | 3/2020 | Quintero | E21B 43/2605 |
| 11,274,532 | B2 | 3/2022 | McGowen | |
| 2002/0092654 | A1 * | 7/2002 | Coronado | E21B 43/105 166/227 |
| 2009/0145595 | A1 | 6/2009 | Mazzanti | |
| 2019/0390537 | A1 * | 12/2019 | McGowen | F04B 47/04 |
| 2019/0390538 | A1 | 12/2019 | Frantz, III et al. | |

OTHER PUBLICATIONS

International Search Report and Written Opinion issued in the related Application Serial No. PCT/US2023/072612 on Nov. 7, 2023.

* cited by examiner

*Primary Examiner* — Crystal J Lee
(74) *Attorney, Agent, or Firm* — Mark H. Whittenberger; Holland & Knight LLP

(57) ABSTRACT

Embodiments are directed towards a lift system for extracting a fluid from a well. The system may include a production tube and at least one bladder located inside a pump barrel which is connected to the production tube. The bladder may include a top connector configured to receive a concentric tubing. The lift system may further include a compression system connected to the concentric tubing. The compression system may be configured to provide a compressed gas through the concentric tubing to the at least one bladder.

18 Claims, 11 Drawing Sheets

1100

ENHANCED ARTIFICIAL LIFT FOR OIL AND GAS WELLS

CROSS REFERENCE TO RELATED APPLICATIONS

This application claims priority to U.S. Provisional Application No. 63/439,389, filed Jan. 17, 2023 and U.S. Provisional Application No. 63/399,790, filed Aug. 22, 2022, the contents of which are all incorporated herein by reference in its entirety.

TECHNICAL FIELD

The present application relates to fluid extraction from oil and gas wells.

BACKGROUND

Oil production in the United States has increased massively since 2007. This has been driven primarily by an intense focus on improving horizontal drilling methods and refining multi-stage completion practices. More than 150,000 horizontal wells have been drilled to date with horizontal wells representing over 80% of all wells drilled in 2021.

In contrast, comparatively little attention has been given to the artificial lift requirements of horizontal oil wells Like vertical wells, as horizontal wells age and reservoir pressure declines, artificial lift technologies are required to achieve maximum hydrocarbon recovery. Artificial lift methods currently utilized in horizontal wells are the same technology that vertical wells have been using for decades.

Most horizontal oil wells require artificial lift from the start, or very early in their lives. Of the wells that flow naturally, most require artificial lift within a few months or years. The most common early life artificial lift methods are either a downhole electrical submersible pump (ESP) or gas lift. Both have long histories in the industry and the choice depends largely on the desired total fluid production rate. As the well ages and reservoir pressure declines, those methods become less efficient. After a certain point, it becomes more efficient to convert to a downhole rod pumping system. Rod pumping is the most common late life artificial lift method and most horizontal oil wells will produce the rest of their lives using this system. It is effective at lifting low to moderate volumes of fluid while drawing the producing bottom hole pressure down further than other legacy lift types.

However, to function effectively, rod pumping and other legacy lift systems are typically installed in the vertical section of a horizontal well or some modest distance into the curve. This places them well above the producing formation which is in the lateral, or horizontal portion of the well. This leads to higher producing bottom hole pressure and, ultimately, higher abandonment pressure compared to a traditional vertical well where the legacy lift systems can be placed at or below the producing formation. The result is lower producing rates and lower ultimate hydrocarbon recovery. In addition, higher producing bottom hole producing pressure makes them less effective at facilitating fluid movement from the lateral, or horizontal section of the well, to the vertical section. This problem becomes more significant later in the life of a well as hydrocarbons can become "trapped" by the tortuosity of the horizontal well path (humps and sumps). The trapping phenomenon is exacerbated by the industry trend of drilling longer and longer laterals. There is significant opportunity to increase producing rates and improve ultimate hydrocarbon recoveries with new artificial lift technology.

SUMMARY

Embodiments included herein are directed towards a lift system for extracting a fluid from a well. The system may include a production tube and at least one bladder located inside a pump barrel which is connected to the production tube. The bladder may include a top connector configured to receive a concentric tubing. The lift system may further include a compression system connected to the concentric tubing. The compression system may be configured to provide a compressed gas through the concentric tubing to the at least one bladder.

One or more of the following features may be included. In some embodiments, the at least one bladder may be associated with a positive displacement pump. The at least one bladder may include at least one flow channel that runs a length of the at least one bladder. The at least one bladder may be configured to inflate and deflate using a controllable cycle. The controllable cycle may be repeated to allow reservoir fluids to be displaced to an above ground level. The production tube, the pump barrel, the at least one bladder, the compression system, and at least one flow control device may operate in closed loop. The at least one bladder may include a plurality of bladders. The lift system may further include an annular check valve associated with the positive displacement pump and at least one flow control device associated with the positive displacement pump to allow fluid to enter the positive displacement pump but exit only through the annular check valve. The flow channel may include one or more of a rod or other material that runs the length of the at least one bladder rod shaped as a helix or some other continuous form, and/or a bladder design that defines a flow channel through use of an indentation, a raised bump or ridge, or some other construction. The controllable cycle may be configured to inflate to displace reservoir fluids out of the positive displacement pump into the production tube above the annular check valve. The controllable cycle may be further configured to deflate to allow reservoir fluids to enter the positive displacement pump through at least one flow control device. At least one mechanical property of the at least one bladder may change as the length of the pump barrel increases. The at least one mechanical property may include one or more of strength, ductility, hardness, tensile strength, elongation, elasticity, and density. The lift system may be configured to operate in a vertical well. The lift system may be configured to operate in a horizontal well.

In another embodiment of the present disclosure a method of extracting fluid from a well is provided. The method may include providing a downhole control valve located above the positive displacement pump. The method may further include regulating a flow of compressed gas during an inflation/deflation cycle using the downhole control valve. The method may also include providing compressed gas into and out of the at least one bladder using a plurality of exclusive flow pathways. The method may further include pressurizing a concentric tubing throughout the inflation/deflation cycle.

One or more of the following features may be included. The method may further include performing the operations of providing a downhole control valve, regulating a flow of compressed gas, providing compressed gas into and out of the at least one bladder, and pressurizing the concentric tubing in multiple wells simultaneously. The method may include inflating the at least one bladder as part of a predefined cycle and/or deflating the at least one bladder as part of a predefined cycle. The method may also include repeating the inflating and deflating to allow reservoir fluid to be displaced to an above ground level.

In yet another embodiment of the present disclosure a method of extracting fluid from a well is provided. The method may include providing a downhole control valve located above the positive displacement pump and regulating a flow of compressed gas during an inflation/deflation cycle using the downhole control valve. The method may further include providing compressed gas into and out of the at least one bladder using a plurality of exclusive flow pathways and pressurizing a concentric tubing throughout the inflation/deflation cycle. The method may further include displacing reservoir fluid above a packer in a vertical section of the wellbore. Once the fluid is displaced above the packer, the method may include engaging a legacy artificial lift system, operating independently, to produce the fluid to an above ground level.

One or more of the following features may be included. The artificial lift system may be configured to operate in one or more of a vertical well or a horizontal well.

This summary is provided to introduce a selection of concepts that are further described below in the detailed description. This summary is not intended to identify essential features of the claimed subject matter, nor is it intended to be used as an aid in limiting the scope of the claimed subject matter.

BRIEF DESCRIPTION OF THE DRAWINGS

Embodiments of the present disclosure are described with reference to the following figures.

Like reference symbols in the various drawings may indicate like elements.

DETAILED DESCRIPTION

Figure 1:
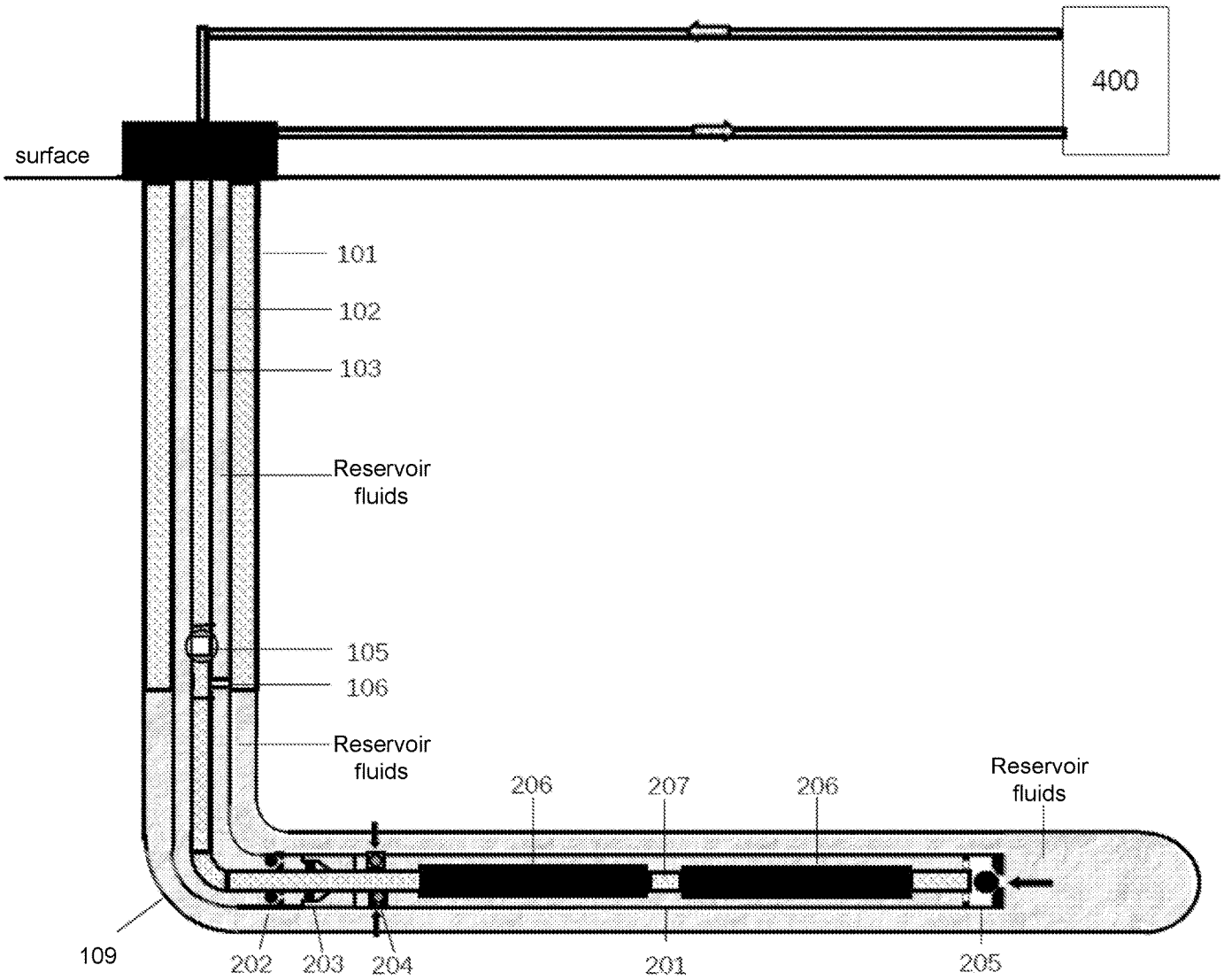
FIG. 1 illustrates a lift system installed in a horizontal well configured to lift fluid to the surface with a downhole control valve and a gas exhaust port consistent with embodiments of the present disclosure.

Embodiments of the present disclosure may provide a method to effectively move reservoir fluids from the lateral, or horizontal section of a wellbore, to the surface. In some embodiments, a positive displacement flex pump ("PDFP") containing a bladder or series of bladders (also referred to as sequential bladders), may be installed in the horizontal or curve section of the well to accomplish this task.

The details of one or more example implementations are set forth in the accompanying drawings and the description below. Other possible example features and/or possible example advantages will become apparent from the description, the drawings, and the claims. Some implementations may not have those possible example features and/or possible example advantages, and such possible example features and/or possible example advantages may not necessarily be required of some implementations.

In some embodiments, an artificial lift system for extracting fluid from a well is provided. The lift system may include a production tubing string (also referred to as production tubing or a tube) and a PDFP connected to and located below the production tubing. The top of the PDFP may include a connector configured to receive a concentric tubing string and a compression system may be connected to the concentric tubing string at the surface. The compression system may be configured to provide compressed gas through the concentric tubing string to the PDFP.

In some embodiments, the lift system may include a bladder as a component of the PDFP. The bladder may be configured to inflate and deflate. The PDFP may also include a rod of some shape that runs the length of the bladder to define a continuous flow channel between the pump barrel of the PDFP and the bladder when the bladder is inflated. The rod may be part of the bladder or separate from the bladder. The rod may be configured as a helix, or any other continuous configuration, and may be affixed to the bladder or to other components of the PDFP. The bladder may be designed to define a continuous flow channel by its construction without need of a rod. The bladder may include multiple layers. The bladder may have varying density or other mechanical properties along its length to facilitate the most effective operation of the bladder. For example, the density of the bladder may decrease along its length. Other mechanical properties that could vary may include, but are not limited to, at least one of strength, ductility, hardness, tensile strength, elongation, elasticity, and density.

In some embodiments, a method of extracting a fluid from a well is provided. The method may include running a PDFP connected to the bottom of the production tubing into the lateral or curve section of the well, inflating the bladder in the PDFP, and displacing fluid towards the heel. From there, the method may include engaging an independently operated rod pumping system or other legacy artificial lift system (also referred to as a conventional method) to extract the fluid from the vertical section of the well. In some embodiments, a packer may be placed between the PDFP and the other legacy artificial lift system to facilitate the operation of both.

Referring now to FIGS. 1-11, embodiments of the subject disclosure are directed to solving the problem of extracting reservoir fluids from late life horizontal wells or any well with insufficient reservoir pressure to flow reservoir fluids to the surface. Generally, a well can flow to the surface naturally until the reservoir pressure declines to a point below the hydrostatic pressure of the produced fluids in the wellbore; at which point the well requires some form of artificial lift to continue production. The producing rate and ultimate recovery of a well are defined in part by the producing bottom hole pressure achieved by the artificial lift system. Existing legacy methods are limited because they are typically installed in the vertical section of a horizontal well or some modest distance into the curve. This limits the bottom hole pressure drawdown achievable by the system, particularly in horizontal wells with toe down well path configurations.

To address the issues above, embodiments of the present disclosure can operate at any point along the lateral thereby facilitating maximum bottom hole pressure drawdown. Embodiments of the present disclosure may, therefore, be able to both accelerate the recovery of hydrocarbons and extend the economic life of the well. It should be noted that the teachings of the present disclosure may be used in accordance with any well type and any embodiments directed towards horizontal or vertical wells are merely provided by way of example.

The discussion below is directed to certain implementations. It is to be understood that the discussion below is only for the purpose of enabling a person with ordinary skill in the art to make and use any subject matter defined now or later by the patent "claims" found in any issued patent herein.

It is specifically intended that the claimed combinations of features not be limited to the implementations and illustrations contained herein but include modified forms of those implementations including portions of the implementations and combinations of elements of different implementations as come within the scope of the following claims. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the claimed invention unless explicitly indicated as being "critical" or "essential."

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

Embodiments of the present disclosure may improve oil and gas recovery by more effectively moving fluids from the lateral of a horizontal well all the way to the surface. The present disclosure creates economic value by allowing reservoir fluids that were previously inaccessible using legacy artificial lift methods to be extracted. The present disclosure also may reduce the environmental impact and greenhouse gas intensity of producing a particular volume of hydrocarbons at the field level. This may be accomplished by replacing hydrocarbons that would have otherwise come from new drills with incremental oil produced using embodiments of the present disclosure. Therefore, the carbon footprint associated with drilling and completing new wells and installing the required facilities may be avoided by using the present disclosure. In addition, fugitive emissions may be reduced in some embodiments by eliminating stuffing box 501 used in rod pumped wells (a persistent leak point and the most common form of late life artificial lift).

As secondary recovery methods are developed and implemented for horizontal wells, effective artificial lift methods will become even more important to achieve effective operations and maximum hydrocarbon recovery.

Embodiments of the present disclosure may also be used in many of the over 800,000 existing vertical wells in the United States. It may provide an effective artificial lift solution while reducing fugitive emissions by eliminating the conventional stuffing boxes 501 used in rod pumped wells (the most common form of artificial lift in vertical wells).

Referring now to FIGS. 1-11, a system implemented in a horizontal well consistent with embodiments of the present disclosure is provided. Embodiments of the present disclosure may be used with various dimensions and shapes of wells, various tubing types and dimensions, and various casing dimensions, etc. It should be noted that while certain examples included herein provide reference to "horizontal" or "vertical" wells the teachings of the present disclosure are not limited to any particular well type.

As shown in FIG. 1, embodiments may include casing string 101 and production tubing 102 that has been installed in the vertical section from the surface to the top connection 203 (also referred to as a heel connector) of PDFP 200 which may be installed in the lateral or curve portion 109 of the wellbore. The well may also contain a concentric string of tubing 103 from surface to the tubing top connection 203 of the PDFP 200.

Figure 2:
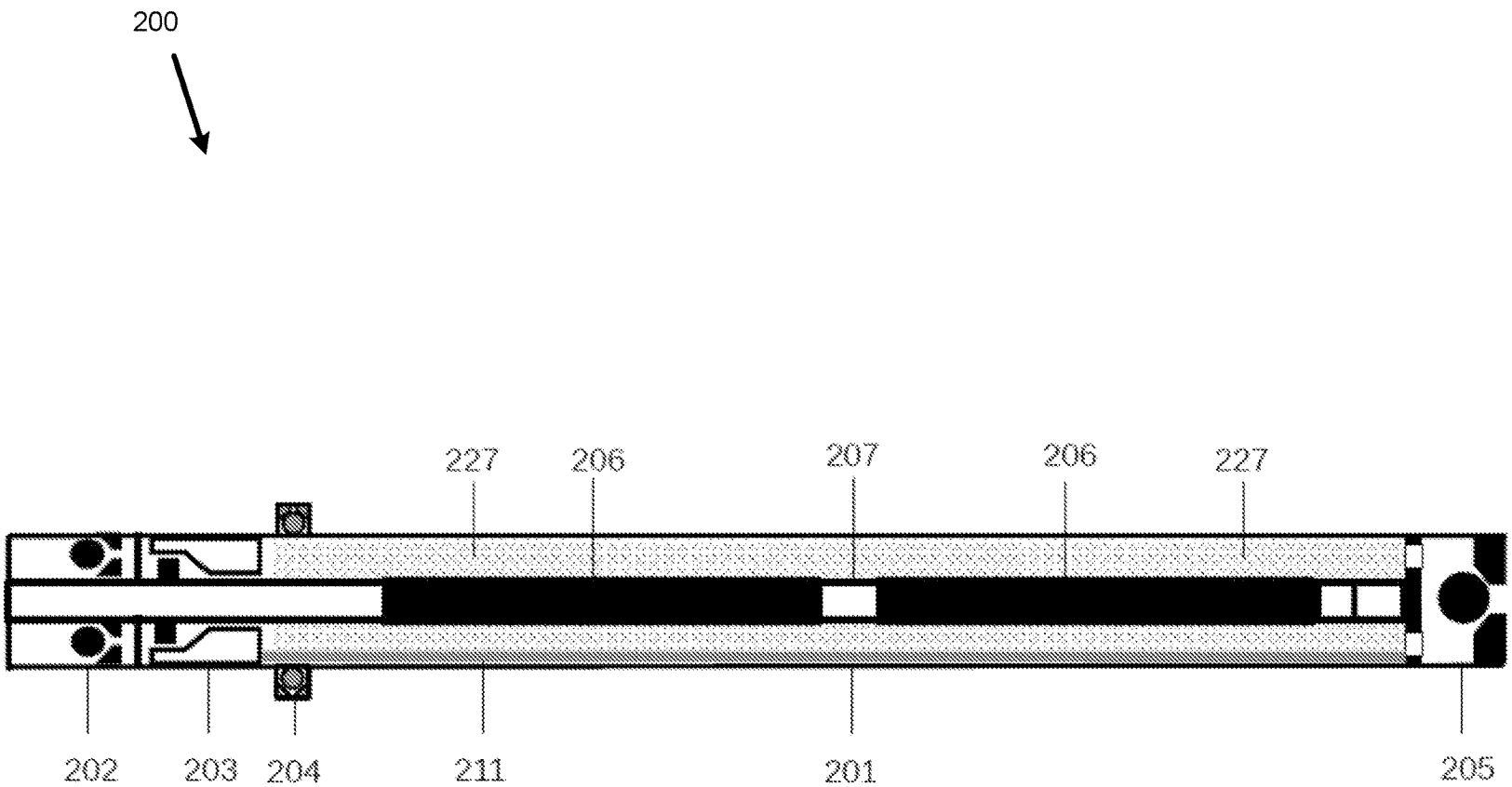
FIG. 2 illustrates a positive displacement flex pump (PDFP) consistent with embodiments of the present disclosure.

As shown in FIG. 2, in some embodiments bladder 206 may be installed inside the PDFP 200. Other embodiments may include a series of bladders 206 installed inside the PDFP 200 to move reservoir fluids from the PDFP 200 all the way to surface. In some embodiments, the number of bladders deployed and the length and/or size of each bladder may be well specific. Similarly, multiple pumps, which may be uniform or of different size may also be used.

In some embodiments, bladder 206 may include one or more connectors at one or both ends of bladder 206. This group of connectors may include one or more specialized connectors. For example, a specialized connector may be used at the top of PDFP 200 to affix the bladder 206 to the pump barrel 201. Another specialized connector may be used to lock bladder 206 in place by connecting bladder 206 with pump barrel 201 at the toe of PDFP 200. This connector may be further configured to release and allow bladder 206 to be removed from the pump barrel. In some embodiments, one possible type of connector that may be used at one or both ends of the bladder may include a crimped connector.

Figure 3:
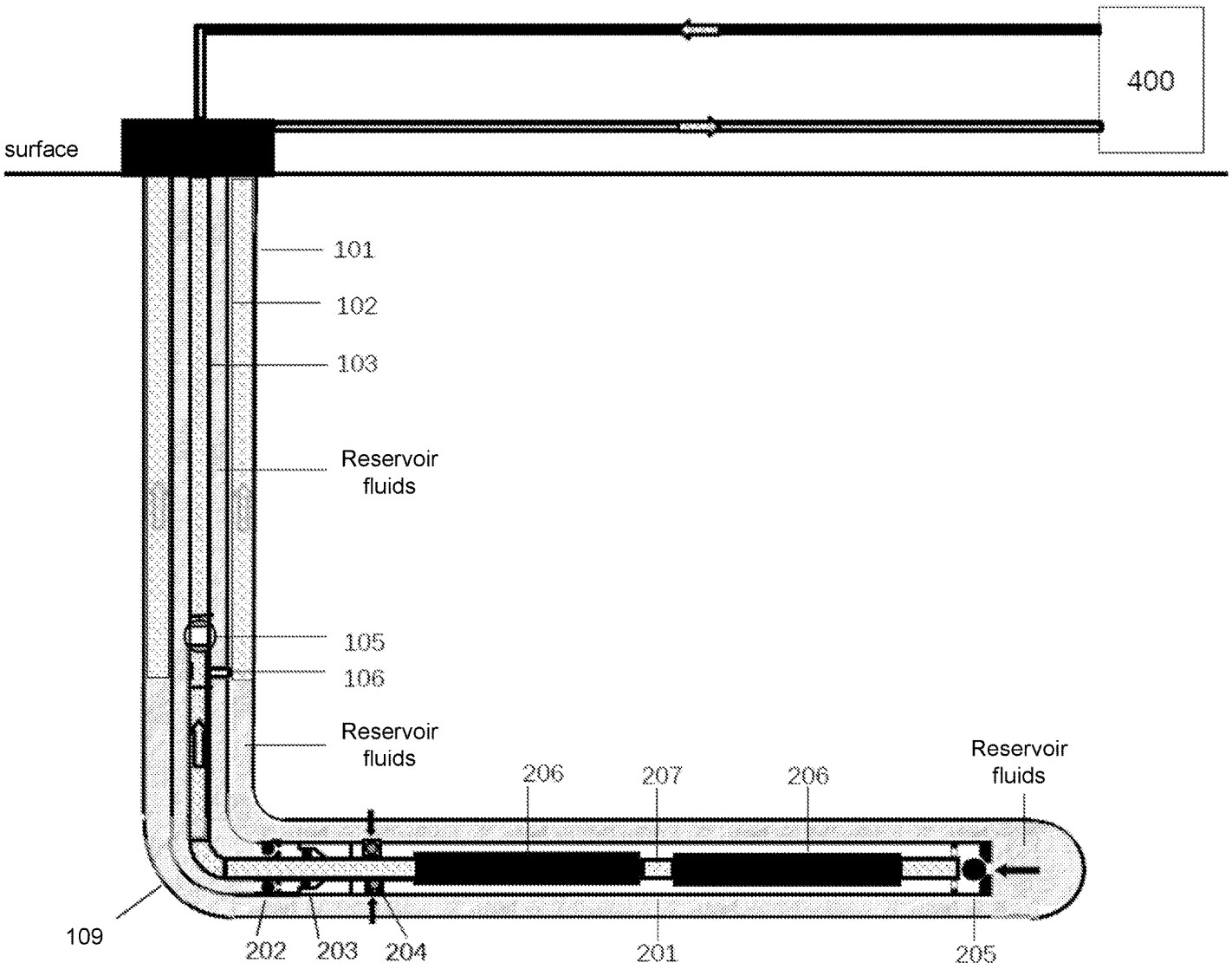
FIG. 3 illustrates a lift system as described in FIG. 1 installed in a horizontal well with a bladder deflated consistent with embodiments of the present disclosure.

As shown in FIG. 3, in some embodiments, top connection 203 of PDFP 200 may include one or more flow control devices 204. The flow control devices 204 may be one-way check valves though any suitable devices may be used without departing from the scope of the present disclosure. Flow control devices 204 may also be spaced throughout pump barrel 201 of the PDFP 200. For example, one or more flow control devices 204 may be spaced to allow reservoir fluids to enter from any angle relative to the circumference of pump barrel 201. Some embodiments may include one or more flow control devices in the toe connection 205 of PDFP 200. Each flow control device 204 and 205 may allow reservoir fluid to enter pump barrel 201 but may prevent reservoir fluid from exiting pump barrel 201 when bladder 206 is expanded. In some embodiments, flow control devices 204 and 205 may be fitted with a filtration media to prevent ingress of solids and debris into the pump barrel. The flow control devices may be designed to provide maximum cross-sectional flow area into the pump barrel while retaining a low crack pressure. The valve may also be designed to operate effectively whether it is installed in the vertical section, the horizontal section or anywhere in the curve.

In some embodiments, a concentric tubing string 103 run inside the production tubing may connect to a compressed gas system 400 at the surface. Tubing top connection 203 may include a top bladder connection configured to receive compressed gas and allow the compressed gas to inflate/deflate the bladder 206. The compressed gas system 400 may be configured to allow bladder 206 to inflate and deflate in a closed loop. The compressed gas may include nitrogen, a suitable inert gas or wellhead gas (natural gas), but other fluids (including liquids) may be used consistent with embodiments of the present disclosure.

Figure 4:
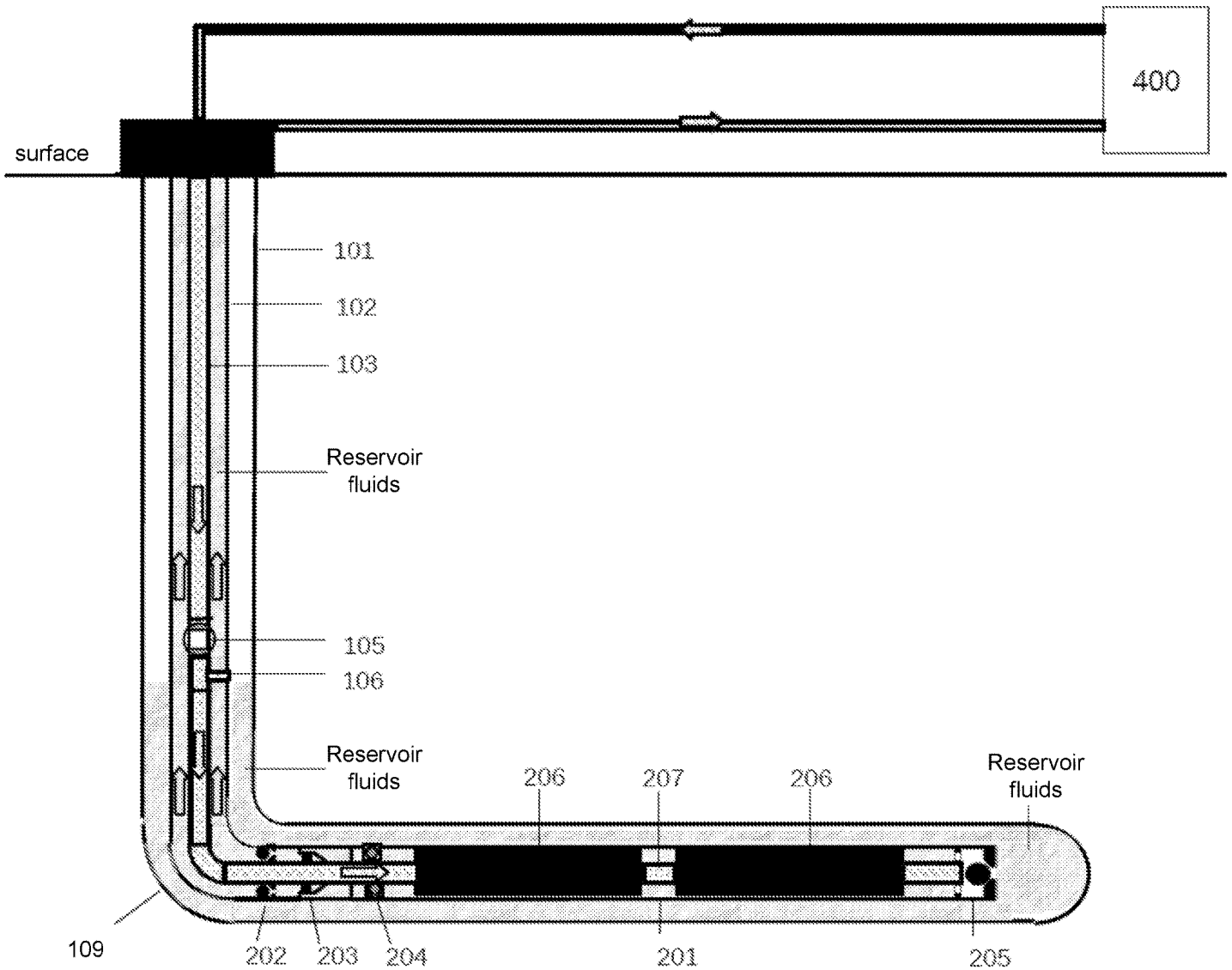
FIG. 4 illustrates a lift system as described in FIG. 1 installed in a horizontal well with a bladder inflated consistent with embodiments of the present disclosure.

As shown in FIG. 4, in some embodiments, an annular check valve 202 may be fitted to PDFP 200. This device may provide one-way flow from below the annular check valve 202 to the annular space between the concentric tubing 103 and production tubing 102 above the annular check valve 202. In some embodiments, a complete lift system may be realized. Each cycle of the PDFP 200 may displace a defined volume of reservoir fluid above the annular check valve 202. With each subsequent inflation/deflation cycle, the volume of reservoir fluid in the production tubing 102 is increased until the production tubing 102 is full. After that point, reservoir fluid will be produced at the surface with each inflation/deflation cycle.

In some embodiments, the compressed gas may be provided by compression system 400. The compression system 400 may include, but is not limited to, a compressor, a gas booster, a nitrogen generator, a pressure vessel, a valving system, and an automation system. The compression system 400 may be a closed loop system and may be located on surface. The capabilities and specifications of the compression system 400 may be based on various well conditions. Examples of well conditions include but are not limited to bottom hole pressure, production rates, the true vertical depth of the well, and the lateral length.

In some embodiments, a single compression system 400 may be configured to facilitate the operation of lift systems on multiple wells.

In some embodiments, mutually exclusive inflation/deflation pathways may be created and operated independently and/or simultaneously in a closed loop system. As shown in FIG. 1, downhole control valve 105 installed above PDFP 200 may be used to control inflation and deflation. The downhole control valve 105 may allow natural gas or other fluid to inflate bladder 206 and, during deflation route the natural gas or other fluid through the downhole control valve 105 through exhaust port 106 to the annulus between production tubing string 102 and casing string 101. The natural gas or other fluid may flow up the annulus along with gas from the well to compression system 400 located at surface. The concentric tubing string 103 may remain pressurized throughout the cycle resulting in overall shorter cycle times.

Figure 5:
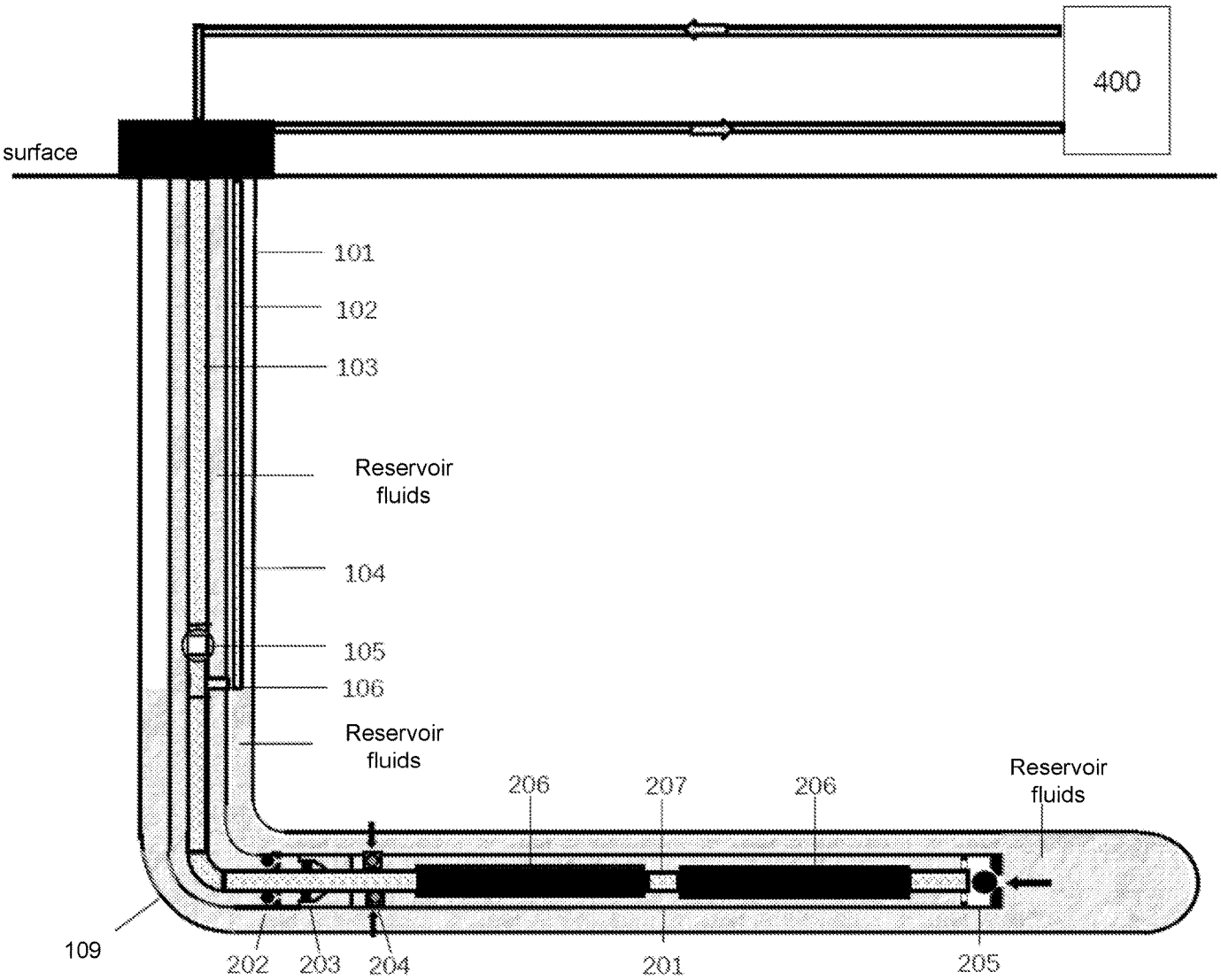
FIG. 5 illustrates a lift system installed in a horizontal well configured to lift fluid to the surface with a downhole control valve and a gas return line consistent with embodiments of the present disclosure.

In other embodiments, during the deflation part of the cycle, nitrogen, natural gas, or other fluids may be routed through exhaust port 106 into side string 104 located outside production tubing 102 to compression system 400 located at surface as shown in FIG. 5. The concentric tubing string 103 may remain pressurized throughout the cycle resulting in overall shorter cycle times.

Figure 6:
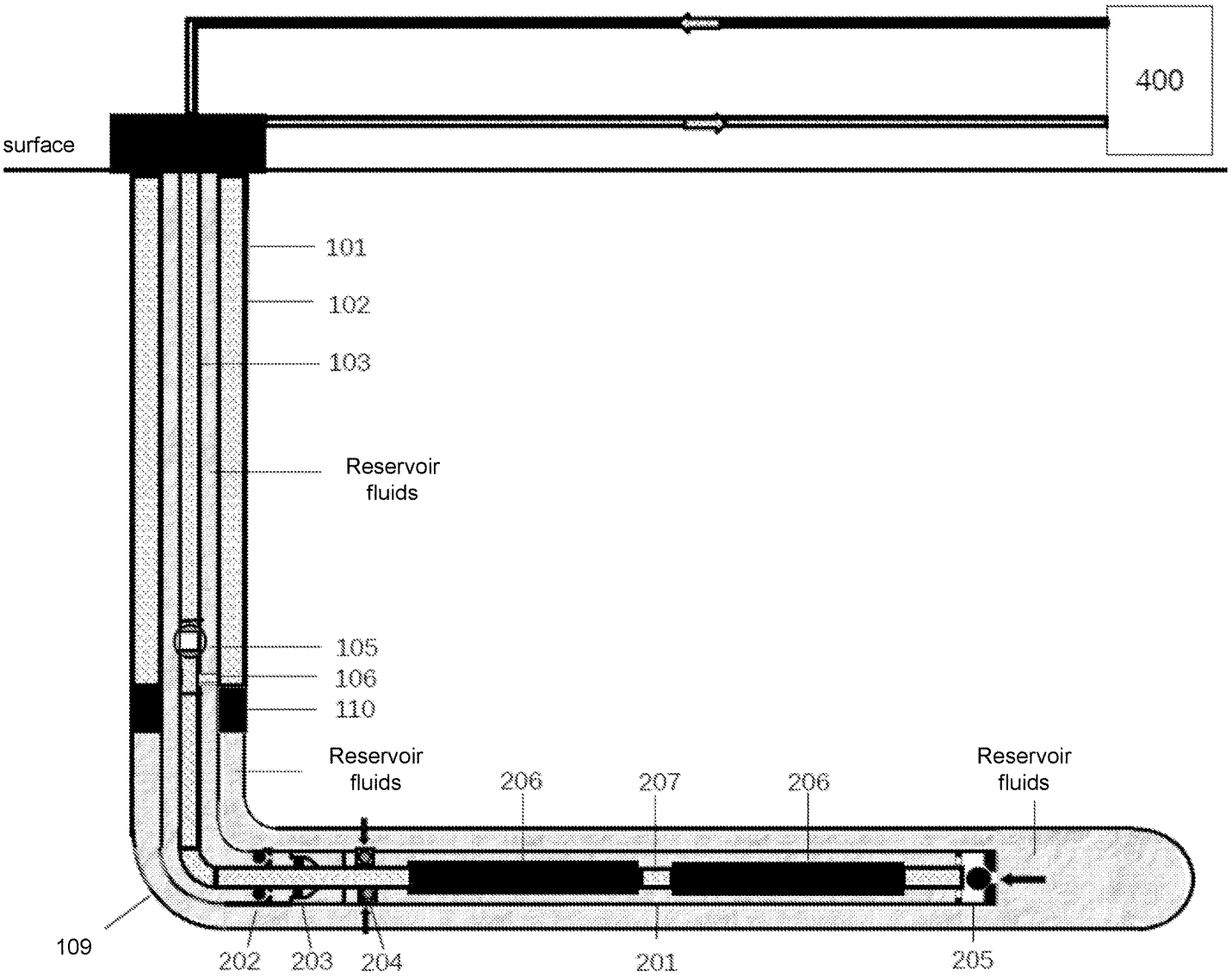
FIG. 6 illustrates a lift system installed in a horizontal well configured to lift fluid to the surface with a downhole control valve and gas exhaust port above a packer consistent with embodiments of the present disclosure.

In other embodiments, as shown in FIG. 6, a packer 110 may be installed above PDFP 200. In this example, during deflation, nitrogen, natural gas, and/or other fluids may be routed through downhole control valve 105 through exhaust port 106 to the annulus between production tubing string 102 and casing string 101. The nitrogen, natural gas, or other fluids may flow up the annulus to compression system 400 located at surface. The concentric tubing string 103 may remain pressurized throughout the cycle resulting in overall shorter cycle times.

In some embodiments, downhole control valve 105 may be retrieved by pulling concentric tubing 103. This may allow for repair or replacement of the valve without pulling production tubing 102 and PDFP 200.

Figure 7:
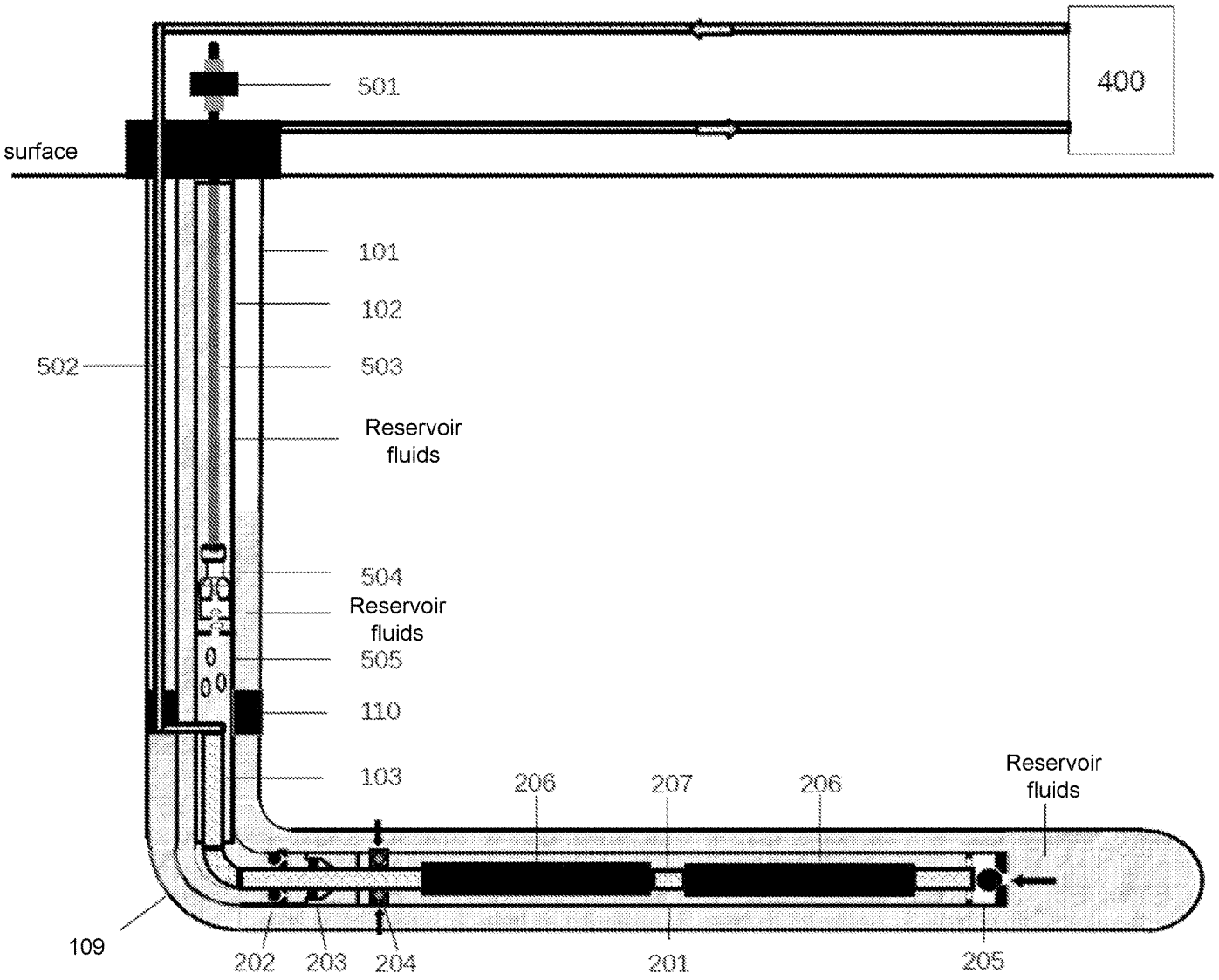
FIG. 7 illustrates a lift system installed in a horizontal well below a packer with a gas supply line to surface configured to lift fluid above the packer and be operated in concert with a rod pumping system consistent with embodiments of the present disclosure.

In some embodiments, as shown in FIG. 7, packer 110 may be installed above PDFP 200. As PDFP 200 moves reservoir fluids above packer 110 into the vertical section, a rod pumping system consisting of sucker rods 503, a downhole rod pump 504 and a perforated sub 505 may be employed. The rod pumping system may operate independently, but in concert with embodiments of the present disclosure to move reservoir fluid from the vertical section to surface.

In some embodiments, secondary tubing string 502 may be installed from surface to a packer 110 with a crossover to concentric tubing 103 to provide communication from surface directly into bladder 206. Secondary tubing string 502 may be a smaller diameter than the production tubing string. During deflation the nitrogen, natural gas, or other fluids used for inflation may flow back up secondary tubing string 502 to compression system 400 located at surface. Other embodiments may include a downhole control system which may route natural gas to the production tubing 102 and casing string 101 annulus. The natural gas may flow along with gas from the well up the annulus to compression system 400 at surface.

In some embodiments, when using nitrogen to inflate bladder 206, some or all the nitrogen routed through exhaust port 106 to the annulus between production tubing string 102 and casing string 101 may be released to the atmosphere rather than being recompressed. Additional nitrogen needed for the subsequent inflation cycle may be supplied by a nitrogen generator located on the surface.

In some embodiments, the PDFP 200 and concentric tubing 103 may be configured to allow running a bladder and later pulling the bladder for repairs without pulling the production tubing string 102.

Figure 8:
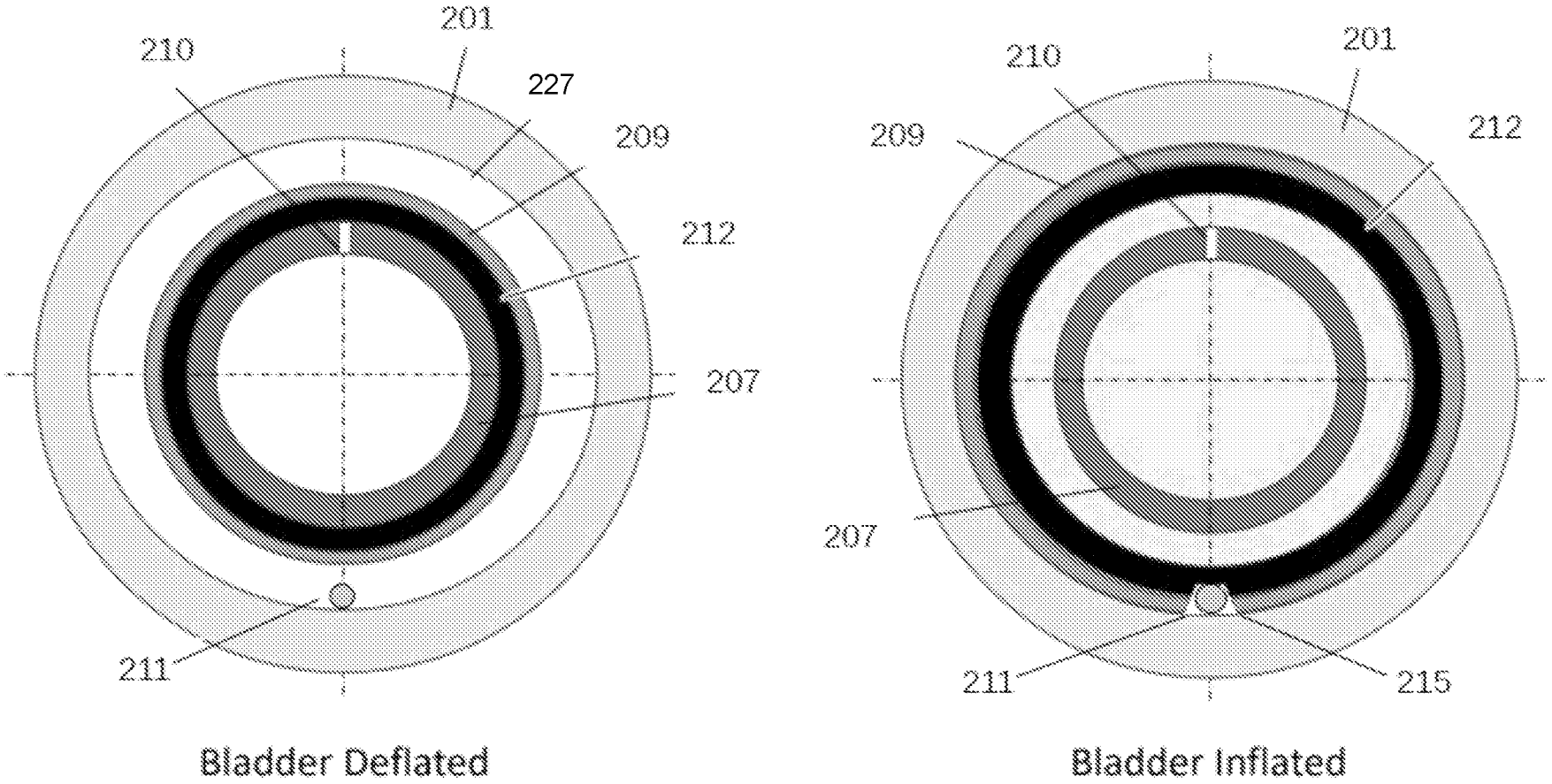
FIG. 8 illustrates a cross-section of the bladder consistent with embodiments of the present disclosure.

In some embodiments bladder 206 may include multiple layers. FIG. 8 is an example of a bladder 206 with three layers, where the three layers include a tubing layer 207, an inner layer 212, and an outer layer 209 (also referred to herein as an outer jacket). Tubing layer 207 may be configured to provide rigidity and structure to facilitate deployment and could be composed of coiled tubing. The next layer of bladder 206 after the tubing layer 207 may be the inner layer 212. The inner layer 212 may be a pressure holding membrane that is responsive to differential pressure. In response to differential pressure, the inner layer 212 may expand. The outer layer 209 may be configured as a protective layer for the inner layer 212. The outer layer 209 may include flow channel 215 (also referred to as a vent channel) all along its length.

Figure 9:
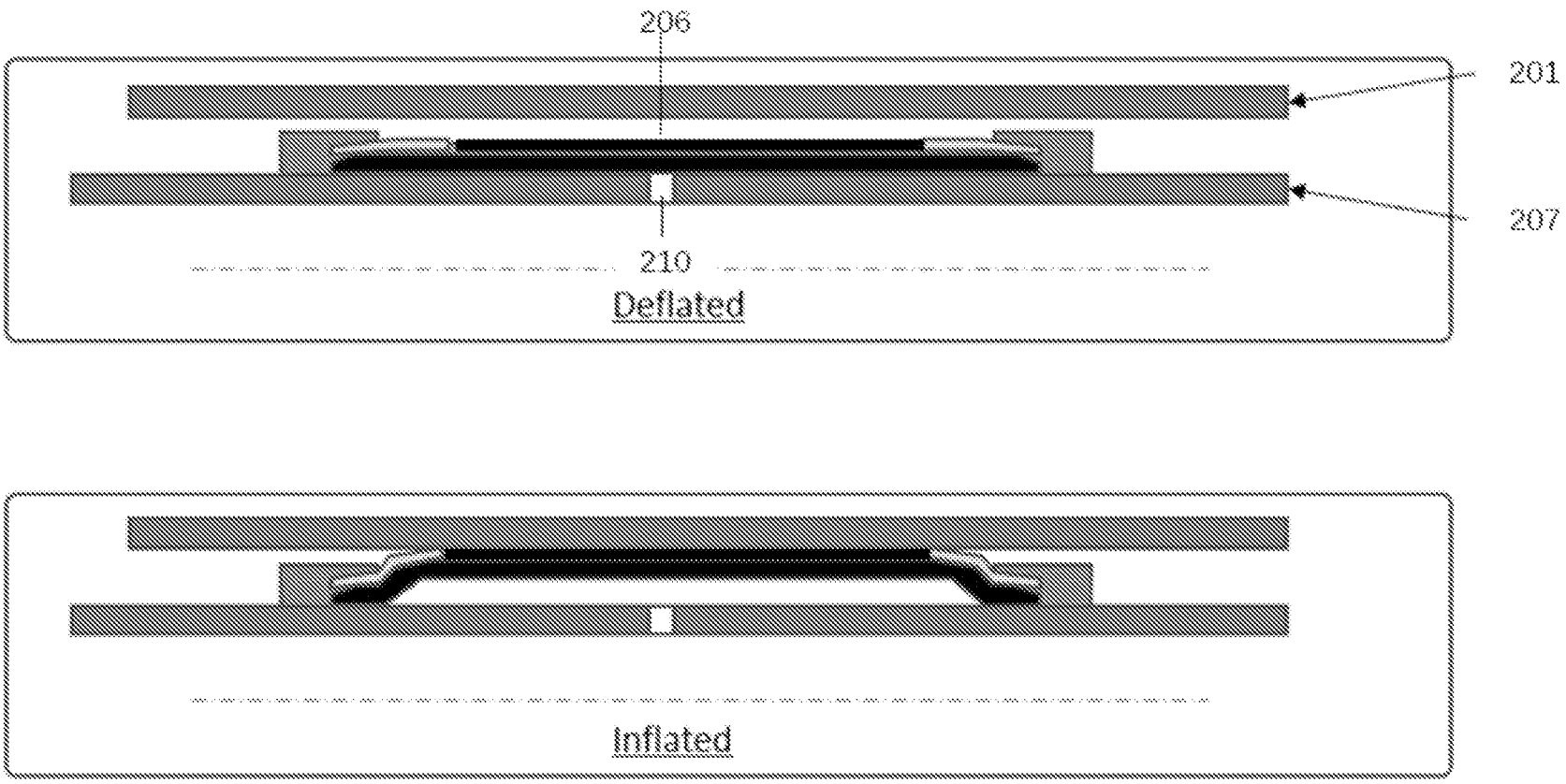
FIG. 9 illustrates a single simplified bladder section with openings consistent with embodiments of the present disclosure.

As shown in FIG. 9, tubing layer 207 may include one or more openings 210 (also referred to as channels) to allow compressed gas applied to bladder 206 to travel between the interior and exterior of tubing layer 207. Specifically, the openings 210 may allow the applied gas pressure to expand the membrane of the inner layer 212 until it is confined by pump barrel 201. At that point pump barrel 201 may provide reinforcement to the bladder 206 and significantly increase the working pressure of the bladder 206.

In some embodiments, tubing layer 207 may be affixed in some manner to the toe of PDFP 200. For example, tubing layer 207 may be latched to the toe of PDFP 200.

In some embodiments, tubing layer 207 within the bladder may be continuous for the entire length of the bladder 206 or may exist only at the ends to facilitate joining bladder sections.

Figure 10:
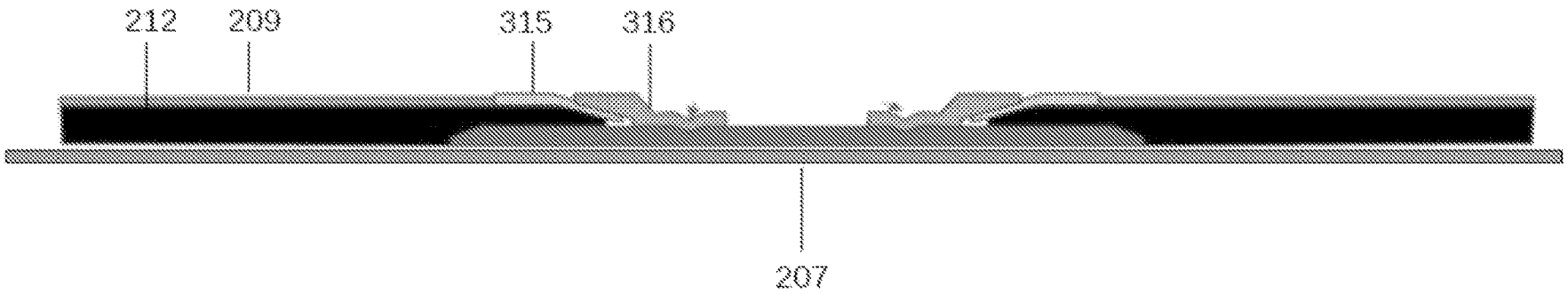
FIG. 10 illustrates a portion of two simplified bladder with specialized end connections and reinforcement architecture consistent with embodiments of the present disclosure.

As shown in FIG. 10, in some embodiments, bladder 206 may be affixed to tubing layer 207 of the PDFP 200 utilizing a special connection 316. This connection may be designed to provide a pressure seal between the bladder 206 and the tubing layer 207. The ends of each bladder 206 may be equipped with special end reinforcement to provide additional bending strength for cyclic loading. Special connection 316 may provide additional mechanical reinforcement through bend restrictors 315.

In some embodiments, inner layer 212 of bladder 206 may be configured as a hose. The hose may be a polymeric hose such as an elastomer but any material or combination of materials suitable to oil and gas extraction may be used in embodiments of the specific disclosure. The material of inner layer 212 may be based on the temperature expected in the well.

In some embodiments, inner layer 212 may be surrounded by outer layer 209. Outer layer 209 may be configured to withstand expected downhole conditions including the process of running into the well and pulling out of the well. Outer layer 209 could be made of any synthetic and/or natural material, including metal strands, etc.

In some embodiments, outer layer 209 and inner layer 212 may be configured to withstand numerous inflation/deflation cycles. Inner layer 212 may be configured to resist deterioration due to temperature and corrosive fluids. Inner layer 212 and outer layer 209 may be configured to expand and reach the inner diameter of pump barrel 201 at moderate differential pressure and contract at moderate negative differential pressure to minimize required system operating pressure. After bladder 206 reaches the inner diameter of pump barrel 201, pump barrel 201 may provide reinforcement to bladder 206.

In some embodiments, and as shown in FIG. 10, PDFP 200 may include a rod 211 of some shape that runs the length of the bladder 206 to facilitate the creation of a continuous flow channel 215 between the pump barrel 201 of the PDFP 200 and bladder 206 when bladder 206 is inflated. Rod 211 may be part of bladder 206 or separate from bladder 206. The rod 211 may be configured as a helix, or any other continuous configuration, and may be affixed to the bladder 206 or to other components of the PDFP 200.

In some embodiments, bladder 206 may be designed to define a continuous flow channel 215 by its construction without need of rod 211 through use of an indentation, a raised bump or ridge, or some other construction.

In some embodiments, bladder 206 may have varying density or other mechanical properties along its length to facilitate the most effective operation of bladder 206. For example, the density of bladder 206 may decrease along its length. Other mechanical properties that could vary may include, but are not limited to, at least one of strength, ductility, hardness, tensile strength, elongation, and elasticity.

In some embodiments, the volume between uninflated bladder 206 and pump barrel 201 may define pump capacity 227. It is the space that reservoir fluid (entering from the producing formation) occupies in PDFP 200. Pump capacity 227 may be filled with reservoir fluid when bladder 206 is deflated and essentially that same volume of reservoir fluid is displaced above annular check valve 202 when bladder 206 is inflated.

In some embodiments, the pressure in bladder 206 may be reduced to a pressure below reservoir pressure during deflation. Reservoir fluid may then enter pump capacity volume 227 through one or more flow control devices 204 and 205 to fill the pump capacity 227 in preparation for another inflation cycle. This repetitive creation of a low-pressure sink, optimized through the use of machine learning or artificial intelligence using various sensor and control elements, may allow embodiments of the present disclosure to increase recovery compared to legacy artificial lift methods. This process of inflating and deflating may repeat as often as necessary, dictated by well conditions, to ensure maximum recovery of hydrocarbons.

In some embodiments, a displacement material may be installed inside tubing layer 207 to occupy some or most of the volume. The displacement material may thereby reduce the amount of compressed gas required to inflate bladder 206. The displacement material may be for example a solid round bar or a liquid, but other configurations of the displacement material are contemplated by this disclosure.

In some embodiments, bladder 206 may be installed inside pump barrel 201 during manufacturing and tested prior to being installed.

In another example embodiment, a bladder running system could be configured whereby bladder 206 may be placed inside coiled tubing prior to running into the well. The coiled tubing could be run inside production tubing 102 and may be seated in the toe of PDFP 200. The seat at the bottom of PDFP 200 may allow the coiled tubing to be removed leaving bladder 206 in place for operation. In other embodiments, bladder 206 may be installed in pump barrel 201 using a leading pump-down dart. In that example pump barrel 201 would be run first, then the bladder would be installed, and finally the production tubing string 102 would be run until the PDFP 200 reaches the desired depth.

In some embodiments, PDFP 200 may be installed completely in the lateral. In other embodiments, the PDFP 200 may run from any point in the lateral around heel 109 into the curve or into the vertical section. Further embodiments may include running PDFP 200 only in the curve or vertical sections.

Embodiments of the present disclosure are configured to extract any combination of reservoir fluids produced by the well. This may include water, oil, natural gas and/or any other fluids found in the reservoir.

Embodiments of the present disclosure may use sensors or feedback mechanisms during the inflation/deflation process. For example, sensors may be placed and configured to: monitor pressure in pump barrel 201; monitor pressure in any tubing or annular space; sense reservoir fluid in or near specific sections of the well; and/or initiate an additional artificial lift method once reservoir fluid reaches a particular section (e.g., trigger a rod pumping system once reservoir fluid is moved out of the lateral). The additional artificial lift method would operate independently but in concert with embodiments of the present disclosure. In some applications a packer 110 may be included between the PDFP 200 and the other legacy artificial lift system to facilitate operation of both systems.

Further embodiments may include control systems located on or near surface and/or downhole to automate the inflation and deflation of bladder 206. Automation of the inflation/deflation of bladder 206 may be based on, for example, the amount of reservoir fluid recovered at the surface and downhole pressure measurements. Sensors may also be used to determine the bottom hole pressure which may help determine reservoir fluid types and volumes produced at various points along the lateral. The entire control system may be monitored and/or controlled remotely and may be optimized using a form of machine learning or artificial intelligence.

In some embodiments, if a rod pumping system is installed in the vertical portion of the wellbore, bladder 206 automation may work in concert with that system. For example, pump off controllers or other sensing devices may be used to optimize the operation of the rod pumping system and provide data to operate bladder 206. While the two lift systems remain independent, this integration may allow both the rod pumping system and embodiments of the present disclosure to operate more effectively. While rod pumping is used as an example, other vertical extraction methods may be used with embodiments of the present disclosure.

Figure 11:
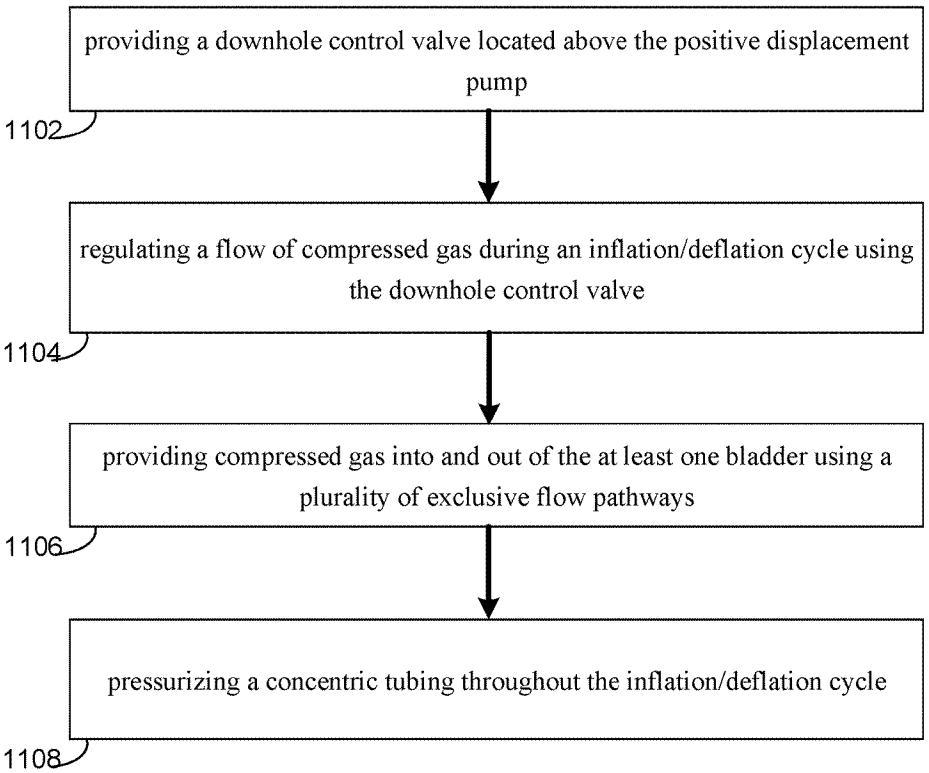
FIG. 11 illustrates a flowchart depicting example operations associated with a method consistent with embodiments of the present disclosure.

In some embodiments, and referring now to FIG. 11, a flowchart 1100 showing an example method of extracting fluid from a well consistent with embodiments of the present disclosure is provided. The method may include providing 1102 a downhole control valve located above the positive displacement pump. The method may further include regulating 1104 a flow of compressed gas during an inflation/deflation cycle using the downhole control valve. The method may also include providing 1106 compressed gas into and out of the at least one bladder using a plurality of exclusive flow pathways. The method may further include pressurizing 1108 a concentric tubing throughout the inflation/deflation cycle.

The present disclosure is configured to be a universal solution for low pressure wells. In practice, the inflation/deflation cycle time may change from well to well, and even from cycle to cycle during operation on a given well. As the well declines and downhole conditions change, the length or other parameters of the PDFP 200 may also be changed. Over time, the PDFP 200 may be moved to any point in the lateral considering, among other things, the tortuosity of the well path to effectively move reservoir fluids along the lateral and lift the reservoir fluids to surface.

In some embodiments, the lift system described in these various embodiments may be applicable in other industries with similar pumping requirements. This could include other downhole applications as well as applications on the surface in various plant facilities or pipelines. The lift system described herein may also be used to displace any fluid, including unwanted fluids from a wellbore. For example, it could be used to unload water and facilitate the restoration of gas flow.

Embodiments of the present disclosure are designed to operate in all standard tubing materials. For example, tubing types may include, but are not limited to, L-80, N-80, or J-55 API grades. Embodiments of the present disclosure may be operated in any size production tubing (e.g., production tubing 102, 202). For example, common tubing sizes may include, but are not limited to, 2⅜" 4.7 lb/ft and 2⅞" 6.5 lb/ft, 8 rd EUE, which are the most common for US land operations. Larger sizes are more common in offshore and international operations and may include, for example, 3½ ", 4½ " and 5½ ", etc.

As discussed above, the present disclosure provides numerous benefits over existing technologies. While some embodiments included herein describe the use of a rod pump it should be noted that rod pumps are not needed to practice the present invention. Moreover, in some existing systems, the bladder and rod pump are tied directly together. These systems require that they must be operated together, which is extremely difficult and inefficient. In contrast, the rod pump and bladder described herein may be separated by a packer and operate independently. The two systems can be operated separately but in a complementary way. Accordingly, embodiments of the present disclosure may effectively create a bridge or buffer between the two allowing for cooperation but still operating independently.

The terminology used herein is for the purpose of describing particular embodiments and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Although a few example embodiments have been described in detail above, those skilled in the art will readily appreciate that many modifications are possible in the example embodiments without materially departing from the scope of the present disclosure, described herein. Accordingly, such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 203, paragraph 6 for any limitations of any of the claims herein, except for those in which the claim expressly uses the words 'means for' together with an associated function.

Having thus described the disclosure of the present application in detail and by reference to embodiments thereof, it will be apparent that modifications and variations are possible without departing from the scope of the disclosure defined in the appended claims.

What is claimed is:

1. A lift system for extracting a fluid from a well comprising:

a production tube;

at least one bladder located inside a pump barrel which is connected to the production tube, wherein the at least one bladder includes a top connector configured to receive a concentric tubing that is located inside of the production tube; and a compression system connected to the concentric tubing, wherein the compression system is configured to provide a compressed gas through the concentric tubing to the at least one bladder, wherein the lift system operates without the use of a rod pump.

2. The lift system of claim 1, wherein the at least one bladder is associated with a positive displacement pump.

3. The lift system of claim 2, further comprising:

an annular check valve associated with the positive displacement pump; and at least one flow control device associated with the positive displacement pump to allow fluid to enter the positive displacement pump but exit only through the annular check valve.

4. The lift system of claim 3, wherein the at least one bladder is configured to inflate and deflate using a controllable cycle and wherein the controllable cycle is configured to:

inflate to displace reservoir fluids out of the positive displacement pump into the production tube above the annular check valve; and deflate to allow reservoir fluids to enter the positive displacement pump through at least one flow control device.

5. The lift system of claim 1, wherein the at least one bladder includes at least one flow channel that runs a length of the at least one bladder.

6. The lift system of claim 5, wherein the flow channel includes one or more of:

a rod that runs the length of the at least one bladder;

a rod shaped as a helix; or a bladder design that defines a flow channel through use of an indentation, a raised bump or ridge.

7. The lift system of claim 1, wherein the at least one bladder is configured to inflate and deflate using a controllable cycle.

8. The lift system of claim 7, wherein the controllable cycle is repeated to allow reservoir fluids to be displaced to an above ground level.

9. The lift system of claim 1, wherein the production tube, the pump barrel, the at least one bladder, the compression system, and at least one flow control device operate in closed loop.

10. The lift system of claim 1, wherein the at least one bladder includes a plurality of bladders.

11. The lift system of claim 1, wherein at least one mechanical property of the at least one bladder changes as the length of the pump barrel increases, wherein the at least one mechanical property includes one or more of strength, ductility, hardness, tensile strength, elongation, elasticity, and density.

12. The lift system of claim 1, wherein the lift system is configured to operate in a vertical well.

13. The lift system of claim 1, wherein the lift system is configured to operate in a horizontal well.

14. A method of extracting fluid from a well comprising:

providing a downhole control valve located above a positive displacement pump;

regulating a flow of compressed gas during an inflation/deflation cycle using the downhole control valve;

providing compressed gas into and out of at least one bladder using a plurality of exclusive flow pathways; and pressurizing a concentric tubing that is located inside of a production tube throughout the inflation/deflation cycle, wherein the method operates without the use of a rod pump.

15. The method of claim 14, further comprising:

performing the operations of providing the downhole control valve, regulating a flow of compressed gas, providing compressed gas into and out of the at least one bladder, and pressurizing the concentric tubing in multiple wells simultaneously.

16. The method of claim 14, wherein the downhole control valve is configured to operate in a vertical well.

17. The method of claim 14, wherein the downhole control valve is configured to operate in a horizontal well.

18. The method of claim 14, further comprising:

repeating inflating and deflating of the at least one bladder to allow reservoir fluid to be displaced to an above ground level.

* * * * *